US007610730B2

(12) United States Patent
O'Connor

(10) Patent No.: US 7,610,730 B2
(45) Date of Patent: Nov. 3, 2009

(54) STACKING MASONRY BLOCK SYSTEM WITH LOCKING STARTER DEVICE

(76) Inventor: Daniel O'Connor, 75 Maple Hill Dr., Millbrook, NY (US) 12545

( * ) Notice: Subject to any disclaimer, the term of this patent is extended or adjusted under 35 U.S.C. 154(b) by 459 days.

(21) Appl. No.: 11/159,049

(22) Filed: Jun. 22, 2005

(65) Prior Publication Data

US 2007/0011979 A1 Jan. 18, 2007

(51) Int. Cl.
*E04B 2/00* (2006.01)
*E04B 5/04* (2006.01)

(52) U.S. Cl. ..... 52/442; 52/604; 52/592.6

(58) Field of Classification Search ..... 52/566, 52/568, 570, 571, 597, 274, 293.2, 293.3, 52/604, 592.6, 606, 745.12, 306, 307, 308, 52/503, 561, 442, 438, 592.3; 33/518, 526, 33/527, 613, 645

See application file for complete search history.

(56) References Cited

U.S. PATENT DOCUMENTS 641,067 A * 1/1900 Blazo ..... 52/438
1,410,588 A * 3/1922 Myers ..... 52/591.2
1,848,357 A 3/1932 Kotrbaty
2,075,665 A * 3/1937 Welch ..... 52/438
2,105,771 A 1/1938 Holdsworth
2,141,397 A * 12/1938 Locke ..... 52/204.2
2,239,537 A * 4/1941 Owen ..... 52/308
2,269,018 A * 1/1942 Guignon, Jr. ..... 52/308
2,329,585 A * 9/1943 Brewer ..... 52/302.4
2,484,062 A * 10/1949 Abbott ..... 52/302.4
2,610,503 A * 9/1952 Hall ..... 52/592.3
2,792,704 A * 5/1957 Kooiman ..... 52/503
3,055,460 A * 9/1962 Maroney ..... 52/293.3
3,180,059 A * 4/1965 Persak, Jr. ..... 52/592.6
3,318,059 A * 5/1967 Wright ..... 52/169.9
3,334,455 A 8/1967 Russell
3,415,026 A 12/1968 Tillisch et al.
3,680,277 A * 8/1972 Martin ..... 52/438
3,683,578 A 8/1972 Zimmerman
3,826,052 A * 7/1974 Tenorio ..... 52/293.3
4,986,048 A * 1/1991 McMarlin ..... 52/306
5,193,320 A * 3/1993 Coccagna ..... 52/442
5,226,276 A * 7/1993 Cahill ..... 52/592.6
5,361,556 A * 11/1994 Menchetti ..... 52/561
5,377,469 A * 1/1995 Schmid ..... 52/396.02
5,524,394 A 6/1996 Szabo, Sr. et al.
5,595,033 A * 1/1997 Frey ..... 52/306
5,881,511 A 3/1999 Keller, Jr.
6,000,186 A * 12/1999 Fielding et al. ..... 52/564
6,012,254 A * 1/2000 Gaston ..... 52/102
6,088,987 A * 7/2000 Simmons et al. ..... 52/592.6
6,138,426 A * 10/2000 Mork et al. ..... 52/562
6,253,518 B1 * 7/2001 Azar ..... 52/589.1
6,606,835 B1 * 8/2003 Bilka ..... 52/604

(Continued)

*Primary Examiner*—Richard E Chilcot, Jr.
*Assistant Examiner*—Brent W Herring
(74) *Attorney, Agent, or Firm*—Schmeiser, Olsen & Watts

(57) ABSTRACT

A masonry block system that employs blocks with unique surfaces, top and bottom, and a locking starter rail for placement below the block wall. The surfaces of the block and the shape of the starter rail are configured so as to lock together, providing a wall system. The system can either be mortarless wherein grout-like material is placed within the blocks to provide a monolithic system. A method of making and installing and various parts, such as the starter rail and block are also disclosed.

11 Claims, 6 Drawing Sheets

U.S. PATENT DOCUMENTS 6,763,644 B1 * 7/2004 Toledo ..... 52/592.6
6,769,220 B2 * 8/2004 Friesner ..... 52/605
6,931,803 B1 * 8/2005 Davis et al. ..... 52/251
7,007,436 B1 * 3/2006 Kelley ..... 52/605
7,127,865 B2 * 10/2006 Douglas ..... 52/745.13
2002/0038532 A1 * 4/2002 Huberty ..... 52/596
2004/0118056 A1 * 6/2004 Peters et al. ..... 52/79.1
2007/0199273 A1 * 8/2007 Wang ..... 52/604

* cited by examiner

STACKING MASONRY BLOCK SYSTEM WITH LOCKING STARTER DEVICE

FIELD OF INVENTION

This invention relates generally to the field of masonry block construction. More particularly, the invention relates to a masonry block system that employs a dry stacking interlocking block system with a unique starter device; various elements of the system; and, a method of installation.

BACKGROUND OF INVENTION

Current methods and systems for masonry block construction have several advantages and disadvantages when compared to comparable cast-in-place concrete construction.

Masonry construction does not typically require formwork, both in erection and teardown, that is found in concrete construction. Masonry construction also typically reaches design strengths quicker than comparable concrete construction. In general, masonry construction is less costly in material and labor costs than concrete construction.

Conversely, masonry block construction typically requires, extensive layout time and labor to properly and accurately start the masonry construction. Further, the time, labor, and material, in the installation of block, including mortar, requires continual adjustment and verification that the block wythes are plumb, level, and in alignment. Often too, masonry block construction does not have the ultimate strength of concrete construction.

Accordingly, there is a need for a masonry block system that offers advantages and improvements over current existing concrete and masonry block construction systems and methods.

SUMMARY OF INVENTION

The present invention provides a stacking masonry block system.

A first general aspect of the invention provides a system of constructing a masonry wall comprising:

a plurality of blocks, configurable in stackable rows, said plurality of blocks having a top surface and a bottom surface, wherein a bottom surface of a first block is configured to match with the top surface of a second block; and a starter rail, configured to mate with said bottom surface, said rail including at least a first longitudinal planar surface and a second longitudinal planar surface wherein an angle between said at least two planar surfaces is acute.

A second general aspect of the invention provides a stacking masonry block system comprising:

a plurality of blocks, each having a configuration for interlocking with adjacently placed blocks;

an elongate starter strip element, configured for placement on a foundation, adapted to interlock with said plurality of blocks placed thereon; and at least one system selected from the group consisting of a hardenable, flowable material placed within said plurality of blocks, and an exterior parging system.

A third general aspect of the invention provides a method comprising:

providing a plurality of blocks, configurable in stackable rows, said plurality of blocks having a top surface and a bottom surface, wherein a bottom surface of a first block is configured to match with the top surface of a second block; and providing a starter rail, configured to mate with said bottom surface, said rail including at least a first longitudinal planar surface and a second longitudinal planar surface wherein an angle between said at least two planar surfaces is acute.

A fourth general aspect of the invention provides a starter element for use in a masonry block system comprising:

a first elongate planar section;

a second elongate section;

a third elongate planar section, wherein said second and third sections are non planar with said first elongate planar section.

A fifth general aspect of the invention provides an interlocking masonry unit comprising:

a volume, defined by an overall height, width, and depth, said volume including a substantially vertical face, said volume including a first mating area and a second mating area, wherein said first mating area is configured to mate with a second mating area of an adjacently placed masonry unit, wherein said first mating area includes a surface that is non-parallel with said substantially vertical face.

The foregoing and other features of the invention will be apparent from the following more particular description of various embodiments of the invention.

BRIEF DESCRIPTION OF DRAWINGS

Some of the embodiments of this invention will be described in detail, with reference to the following figures, wherein like designations denote like members, wherein.

DETAILED DESCRIPTION OF THE INVENTION

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. Although the drawings are intended to illustrate the present invention, the drawings are not necessarily drawn to scale.

Figure 1:
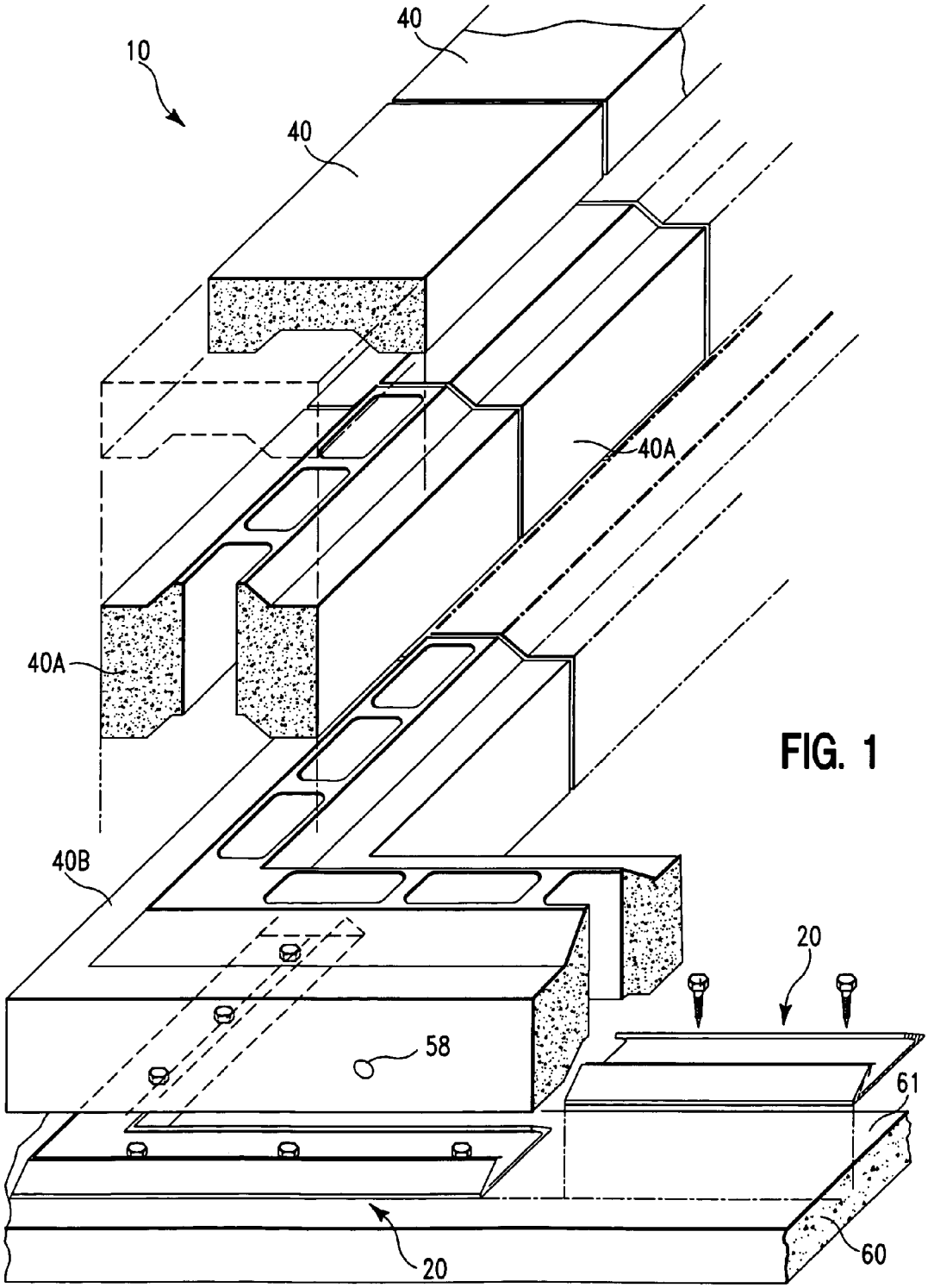
FIG. 1 depicts an exploded perspective view of an embodiment of the interlocking masonry block system, in accordance with the present invention.
Figure 3A:
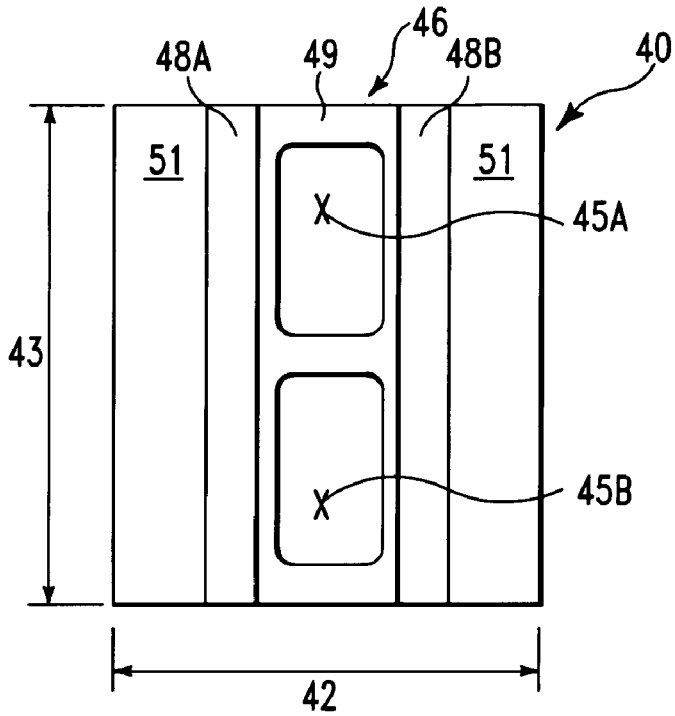
FIG. 3A depicts a top view of a first embodiment of a masonry block, in accordance with the present invention.
Figure 3B:
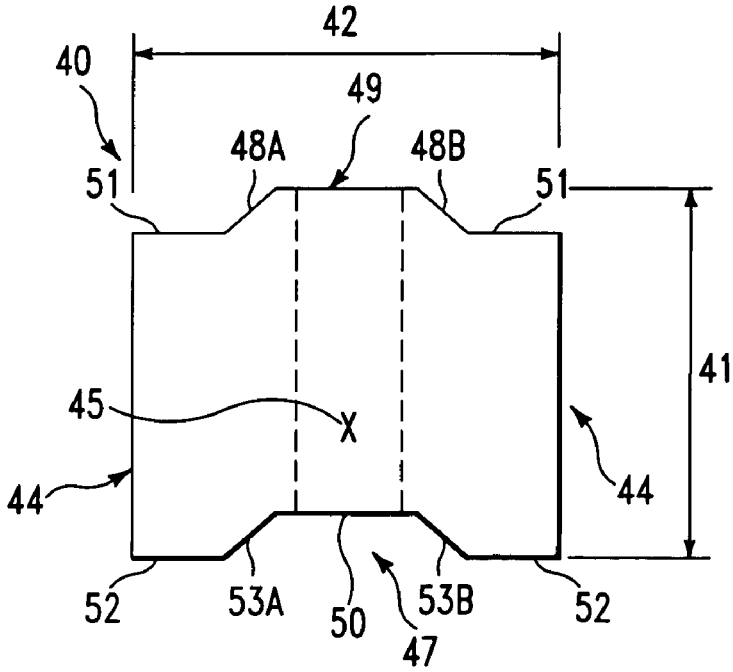
FIG. 3B depicts an end view of the first embodiment of a masonry block, in accordance with the present invention.
Figure 3C:
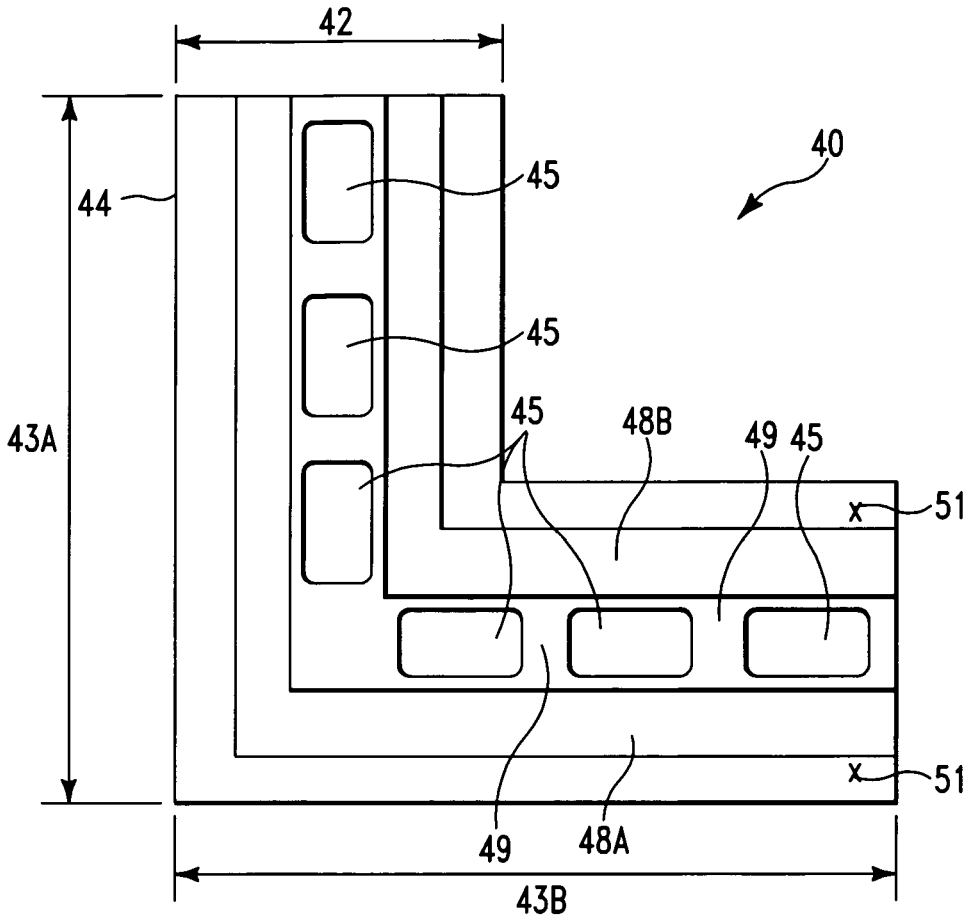
FIG. 3C depicts a top view of a second embodiment of a masonry block, in accordance with the present invention.
Figure 3D:
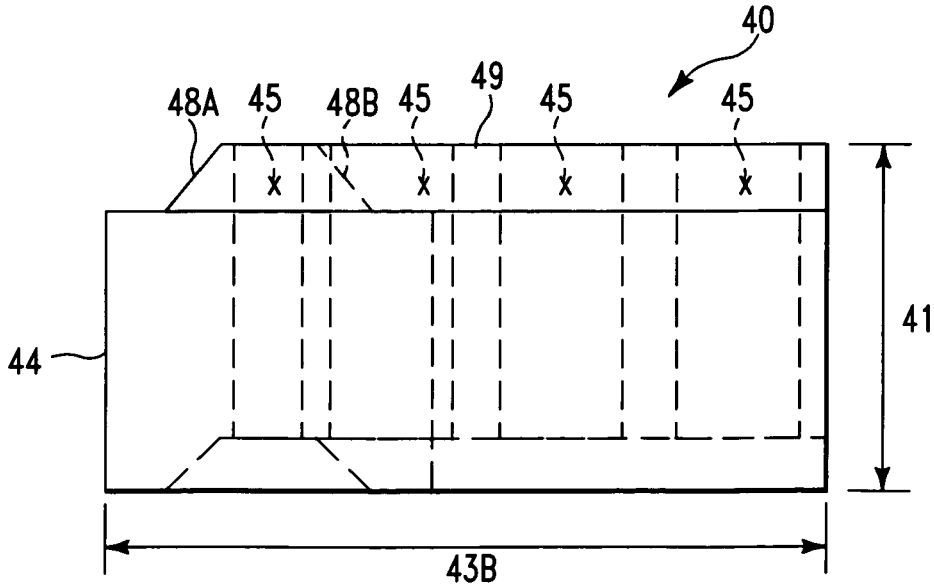
FIG. 3D depicts an end view of the second embodiment of a masonry block, in accordance with the present invention.
Figure 3E:
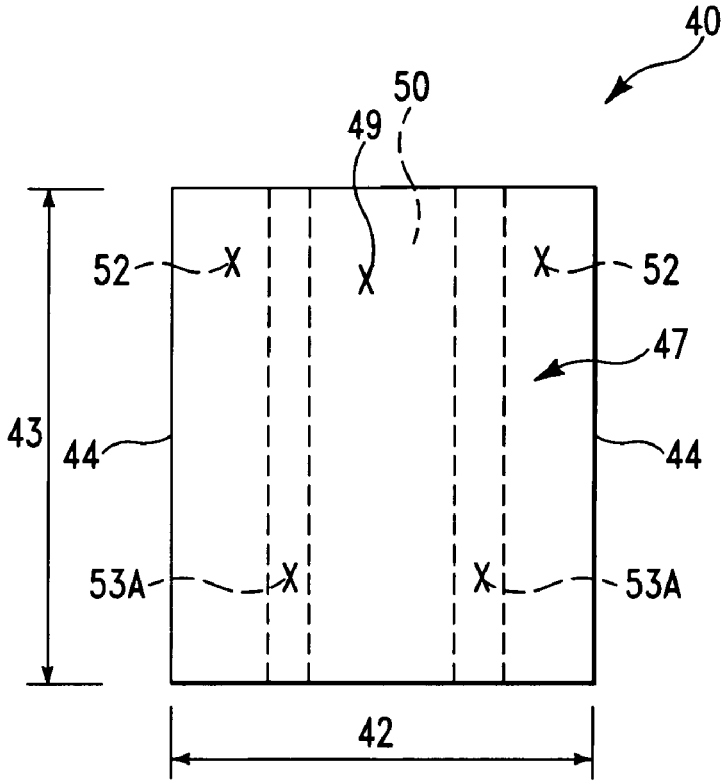
FIG. 3E depicts a top view of a third embodiment of a masonry block, in accordance with the present invention.
Figure 3F:
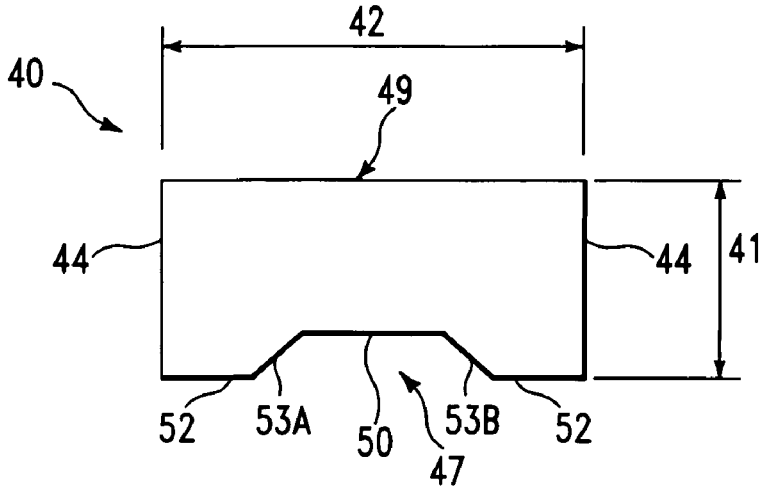
FIG. 3F depicts an end view of the third embodiment of a masonry block, in accordance with the present invention.
Figure 4:
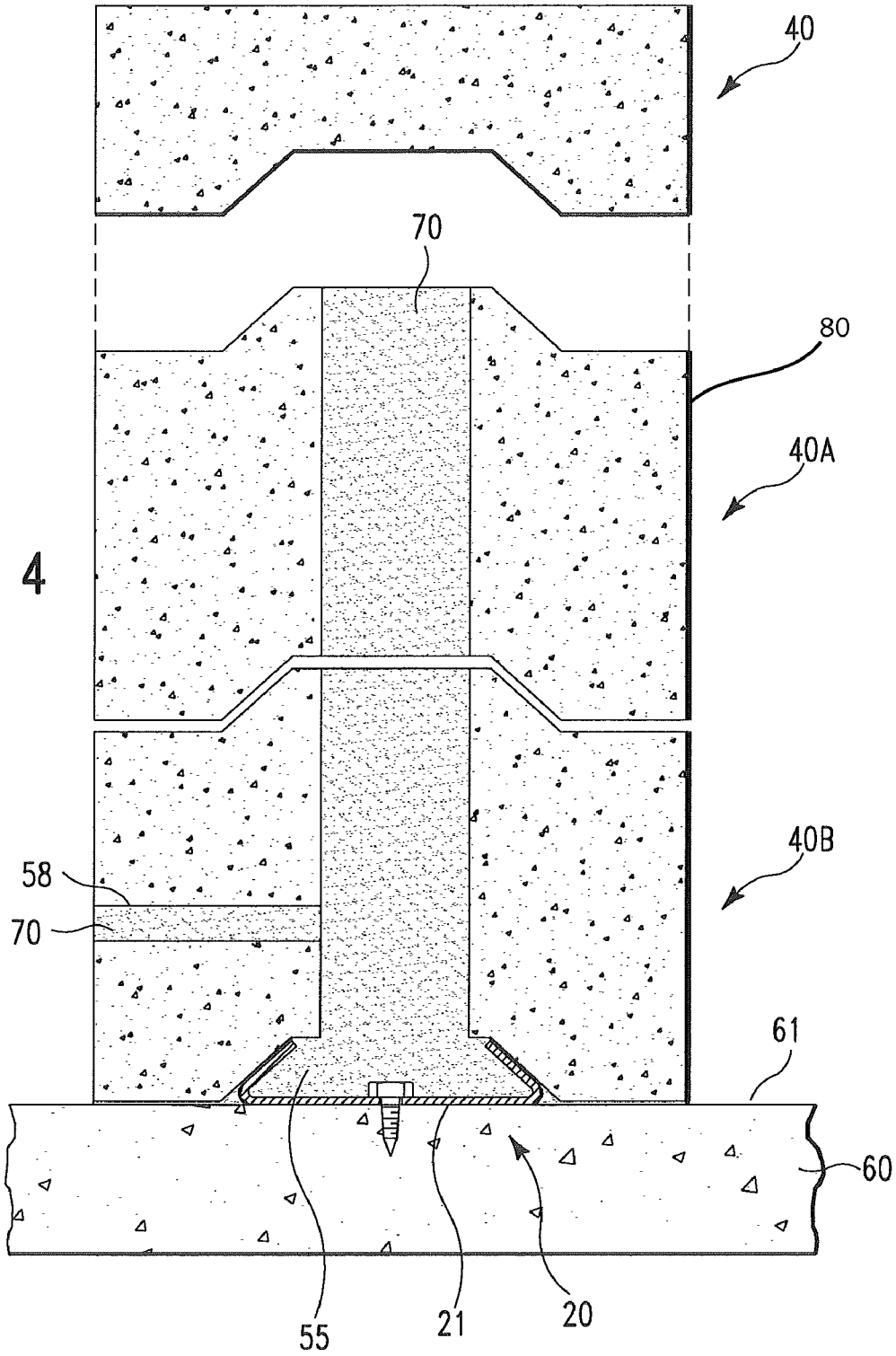
FIG. 4 depicts a close-up sectional view of a portion of the interlocking masonry block system, in accordance with the present invention.

Turning to the figures, an exploded perspective view of an embodiment of the invention, is depicted in FIG. 1, while FIGS. 2-4 show various details of the invention.

FIG. 1, shows a typical foundation footer 60, often made of concrete, having a top surface 61. Resting and bearing on the footer 60 is a system 10 of the invention. A starter element 20, and a plurality of blocks 40 are placed together on the footer 60. Upon satisfactory installation of the starter elements 20 and the blocks 40, flowable, hardenable material 70 is subsequently placed within the cavities 45 (see e.g., FIG. 4) to bond the entire construct together. In this manner the system 10 is a mortarless, block-type construct having an increased strength.

Figure 2B:
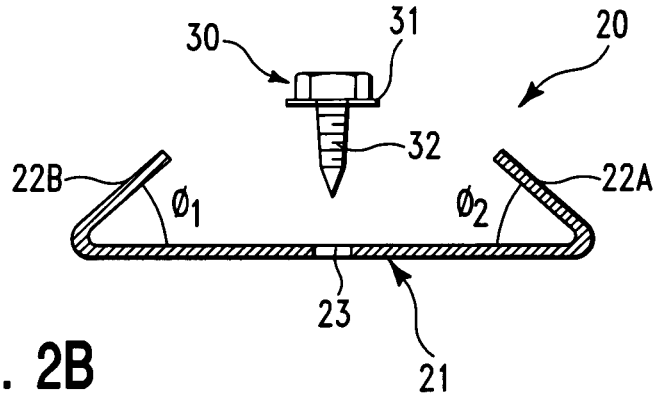
FIG. 2B depicts an end sectional view of an embodiment of a locking starter device, in accordance with the present invention.
Figure 2A:
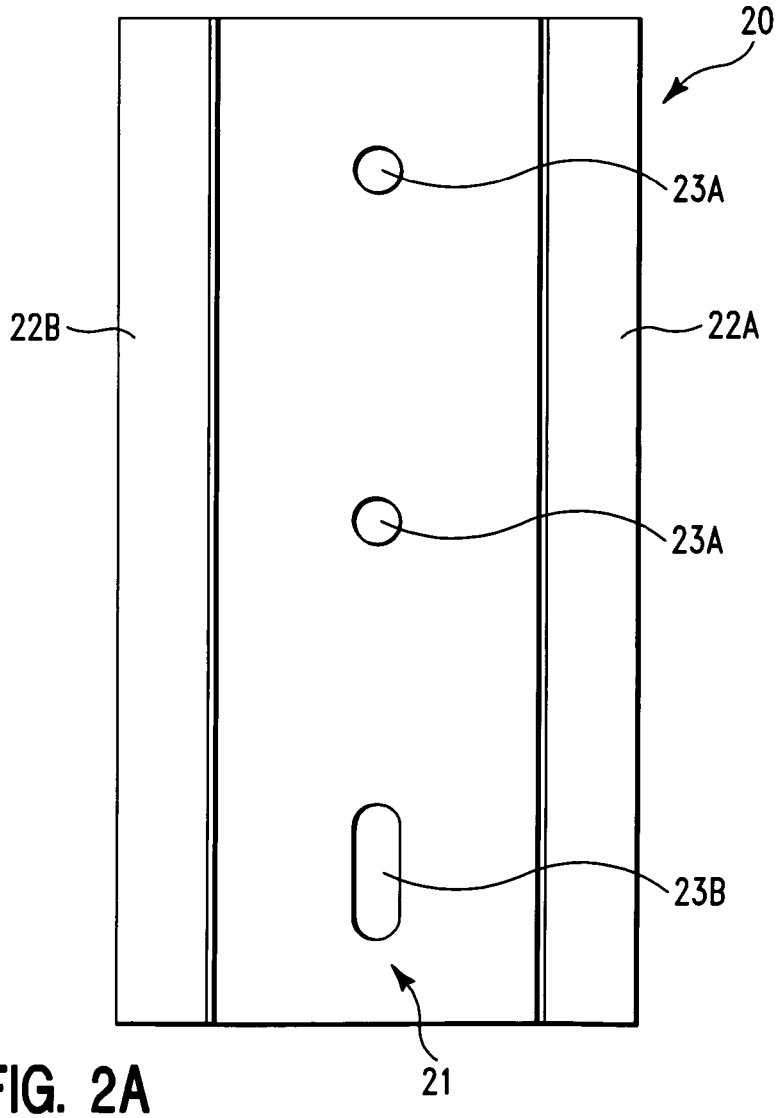
FIG. 2A depicts a top view of an embodiment of a locking starter device, in accordance with the present invention.

As shown in FIGS. 1, 2A, and 2B, the detail and configuration, of an embodiment of a starter strip 20 is shown. The starter strip 20, or element, is typically longitudinal in shape comprised of a plurality of elongate, planar surfaces. The strip 20 includes a first, or base, longitudinal planar section 21, and a second longitudinal planar section 22A. There may be additionally a third longitudinal planar section 22B.

The base 21 is configured to lay upon the footer top 61. The base 21 may include a plurality of openings 23 (e.g., 23A, 23B, etc.) shaped to allow various connectors 30 to connect the strip 20 to the footer 60. The openings 23 may be holes, slots, and the like. Similarly, the openings 23 may be spaced and configured to suitably attach the strip 20 to footer 60. For example, FIG. 2B shows one method of attachment, wherein the connectors 30 are a plurality of screws 30 with threads 32 and washers 21 are drilled into the footer 60 in either pre-drilled holes or in a self-tapping manner so as to attach the strip 20 to footer 60. Additionally, the openings 23 are available for allowing reinforcing bar, mechanical or electrical "stub ups", and the like, to pass through the base 21. The strip 20 may be made of a suitable rigid, or semi-rigid, material so that upon its installation the alignment and placement of strip 20 is maintained so as to allow accurately subsequent placement of the blocks 40 upon the strip 20. For example, the strip 20 may be constructed of steel, galvanized material, stainless steel, cold-rolled steel, composite material, and the like. The base or first planar surface 21 is co-planar to the base of at least one of the plurality of blocks 40 when one of the plurality of blocks 40 is placed over the starter rail 20.

Various means and methods may be used to attach the strip 20 to the footer 60. While FIG. 2B shows screws 30 as attachment means, the connectors 30 may be, for example, threaded rod (e.g., J-bolts, straight rod, etc.) embedded within the footer 60 and partially extending above the footer 60. With this means of attachment, the strip 20 is attached to the plurality of threaded rod via nuts. Still alternatively, the strip 20 may be attached to the foundation 60 via a permanent adhesive (e.g., epoxy), and the like. In other embodiments, if the structural application allows, the strip 20 may be lightly pinned down, or laid in place, on the foundation 60, with, for example, aesthetic, light construction, low walls.

The second longitudinal planar section 22A and the third longitudinal planar section 22B are non-parallel with the base 21. Additionally, the second and third planar sections 22A, 22B may be non-parallel to each other. Further, the second and third planar sections 22A, 22B may each form an acute angle, $\phi_1$ and $\phi_2$, respectively, with the base 21. Further, angles $\phi_1$ and $\phi_2$ may, or may not, be equal to each other.

It should be apparent that various configurations of planar sections 21, 22A, 22B are part and parcel of the present invention. For example, any, or all of the sections 21, 22A, 22B may be less than entirely solid. That is the sections 21, 22A, 22B may have various openings. The sections 21, 22A, 22B may be lattice-like in their construction. The openings (not shown) may exist in order to allow the ready flow, or passage of flowable, hardenable material 70 throughout the system 10; to allow for additional elements (not shown) to pass through; to provide a lighter weight strip 20; and the like. Further, while the embodiment in FIGS. 2A and 2B depict sections 21, 22A, 22B that are smooth in construction, clearly appendages, projections, depressions, detents, and the like, can be added while not diverging from the intent of the invention.

Similarly, various configurations of the strip 20 may be employed. The strip 20 can come in various lengths of straight sections. The strip 20 also can be on an angle for constructing corners. The strip 20, thus, may be any angle. The strip 20 can be made on a curve, or multiple curves, of any radius. In these embodiments, the strip 20 can be rigid so that the shape and configuration is fixed. Alternatively, the strip 20 may be semi-rigid. That is, the strip 20 may be constructed so that its shape and configuration may user-adjustable in the field to any angulation and/or curvature. For example, the strip 20 may have gaps or other constructs that allows the installer to move, shape, and bend the strip 20 to the desired configuration. Once installed to the foundation 60, the strip 20 provides a virtually errorless method for installing the subsequent blocks 40.

Turning to FIGS. 3A-3F, several embodiments of blocks 40 are depicted in detail. While FIGS. 3A and 3B show, what could be termed a "typical" or "standard" block 40, in accordance with the present invention, FIGS. 3C and 3D show a corner block 40 while FIGS. 3E and 3F show a capstone block 40. While each embodiment of block 40 has its particular use, they share common aspects of the invention.

The block 40 has an ultimate height 41, depth 42, and length 43. The block 40 has two substantially vertical faces 44 which are exposed to view after installation. The block 40 includes a first mating area 46. With the exception of the capstone block 40 (see FIGS. 3E and 3F), the block also includes a second mating area 47. The block 40 includes a top bearing surface 51 and a bottom bearing surface 52. Interstitial to the substantially vertical faces 44 is at least one opening 45.

Both first mating area 46 and second mating area 47 include a horizontal face 49, 50 and typically two canted (i.e., non-horizontal) surfaces 48A, 48B. Thus, the configuration of the blocks 40 are such that the first mating area 46 is shaped so as to mate, fit with the second mating area 47 of an adjacently placed block 40. More specifically, the canted surfaces 48A, 48B and the horizontal faces 49, 50 are such that blocks can readily by placed by the installer easily. Similarly, the first mating area 46 is configured so as to mate, fit with the starter strip 20, as well.

The configuration of the strip 20 and blocks 40 make installation much quicker and easier than typical block construction. For example, continual checking for alignment, plumbness, etc. is not required as in the prior art, or at the least mitigated significantly. That is once the starter strip 20 is properly aligned and attached (fixedly or removably) to the footer 60, all subsequently aligning activity is abolished, or significantly mitigated.

Clearly, the block 40, may be constructed of any suitable height 41, depth 42, and/or length 43, depending on the particular requirements needed. For example, in the L-shaped embodiment as shown in FIGS. 3C and 3D, the first length 43A may be unequal to the second length 43B.

Similarly the mating surfaces 46, 47 need to be on both the top and bottom of the block 40. For example, both a first mating surface 46 and second mating surface 47 are on some embodiments of block 40 (see e.g., FIGS. 3A-3D). Contrastingly, the embodiment depicted in FIGS. 3E and 3F, termed a "capstone", have only a second mating surface 47 on the bottom of the block 40. Other embodiments (not shown) may have only a first mating surface 46 on the top of the block 40. That is the bottom of the block 40 may be substantially planar. Such an embodiment may be used as a header, or lintel, over a doorway or window opening in the system 10.

Optionally, reinforcing bar or other suitable reinforcement (not shown) may be located within, or extending through, the block 40.

FIG. 4 shows a close up sectional view of a portion of a wall installed under the current invention. A footer top 61 has the strip 20 installed thereon. A first block 40A and second block 40B are shown on top of each other and on the strip 20, in turn. The configuration of the second and third planar sections 22A, 22B as they relate to the configuration of the entire first mating area 46 and the canted surfaces 48A, 48B, are such that upon the installation of the first block 40A a void space 55 is created between the bottom of the face 50 and the strip 20.

Subsequent to the installation of the blocks 40 a flowable, hardenable material 70 is placed, or pumped, into the openings 45. The material 70 may be grout, mortar, concrete, epoxy, and the like. In this manner, a monolithic construct is created between the block 40, material 70 and the footer 60.

The material 70 thus can flow within all the openings 45 in all the blocks 40 as well as into the void 55 around the strip 20. Thus, the material 70, once hardened, converts the block 40 and strip 20 construct into a monolithic structure that is strong in tension, compression, in shear, and the like. The mating areas 46 and 47 add to this aforementioned strength. The strength between adjacent blocks 40A, 40B is greater.

The shape of the starter strip 20 and the void 55 it creates under a first block 40B are such that, once the void 55 is filled with the flowable, hardenable material 70, and once the material 70 hardens, that the material 70 is prevented from moving in the vertical direction with respect to the adjacent blocks 40 in the system 10. That is, the strip 20 and the void 55 together may allow the material 70 to act as a type of key in the system 10. Therein, the system 10 is locked to the foundation 60 below.

As shown in FIG. 4, an optional weep opening 58 may be located on at least one block 40B so as to allow the escaping off of trapped air within the openings 45 during the placement of the material 70. The weep opening(s) 58 may also serve as a viewing port for quality control purposes, to allow, for example, construction inspectors to visually confirm that the flowable material 70 has infiltrated all the openings 45 in the block 40. The weep opening 48 may be singular, or plural, on each block 40 and may be located in any suitable location on the block 40.

Clearly, other variations and embodiments are part and parcel of the invention.

One such variation is that the foundation 60 can be any suitable material for placement and support of the system 10. The foundation 60 is not just limited to concrete footers and the like. Rather, the term as used herein may include suitably compacted gravel, soil, and the like. Similarly, the system 10 can be installed on a foundation 60 constructed specifically for this application. Contrastingly, the system 10 may bear directly on a preexisting concrete slab (e.g., slab on grade, elevated slab, etc.). Thus, the system 10 suits itself for new construction and/or renovation work; exterior and/or interior partitions; building construction and/or landscaping/sitework constructs; and, as a bearing or non-bearing construct. The system 10, for example, can be used to create interior partitions (e.g., partial height, full height, etc.) in an existing building to parcel the existing space into subspaces.

Another aspect of the invention allows for various material to be placed on the exterior of the walls of the system 10. That is aesthetic; non-structural; and/or, structural materials and/or systems may be placed on the faces of the blocks 40 once installed. For example, the system 10 can be covered with paint, covered with waterproofing, furred out with a wall system, covered with parging, covered with insulation, or other systems.

Alternatively, an exterior structural-type parging system 80 (e.g., ⅛" to ¼" thick) may be added that provides a waterproofing, aesthetic, and/or interlocking strength aspect to the system 10. One type of system that may be added is an Exterior Insulation and Finish System (EIFS), such as the system sold under the name, DRYVIT. Depending on the type of system that is placed on the exterior of the system 10, flowable, hardenable material 70 may not necessarily be required to be placed internal to the block 40. Thus, this exterior system may be used in lieu of, or in addition to, the flowable, hardenable material 70 placed within the blocks 40. Alternatively yet, a hybrid system may be employed wherein the exterior parging system is used, while flowable, hardenable material 70 is only placed in select portions of the system 10. For example, flowable, hardenable material 70 might only be placed where structurally necessary, such as in the corners of the construct and where buttresses, piers, and/or pilasters exist (i.e., locations of greater stress), while the exterior parging system is located on the exterior of the blocks 40 throughout.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

I claim:

1. A masonry block system comprising:

a plurality of blocks, configurable in a stackable row, each of said plurality of blocks having a top surface and a bottom surface, wherein said bottom surface of each of said plurality of blocks is configured to match with the top surface of each of said plurality of blocks, wherein each of said plurality of blocks contains a cavity such that said stackable row has a vertical opening therethrough; and a starter rail, configured to mate with said bottom surface of each of said plurality of blocks and configured to be in communication with said vertical opening, said rail including at least a first longitudinal planar surface and a second longitudinal planar surface longitudinally connected to the first longitudinal planar surface, wherein an angle between said first longitudinal planar surface and said second longitudinal planar surface is acute and forms a void when one of the said plurality of blocks is placed over said starter rail, wherein the first longitudinal planar surface is co-planar to a base of the one of the said plurality of blocks when the one of the said plurality of blocks is placed over said starter rail, and wherein the bottom of said void has a larger width than the width of the vertical opening, such that when hardenable, flowable material is poured into said opening and void of said starter rail, movement of the blocks is prevented.

2. The system of claim 1, wherein said starter rail further comprises a third longitudinal planar surface being non-parallel with both said first and second longitudinal planar surfaces.

3. The system of claim 2, wherein said first, second, and third longitudinal planar surfaces form the void upon the placement of said first block over said starter rail, and said void and starter rail act as a key in the system to lock the system to the foundation.

4. The system of claim 3, wherein said void faces upwardly and is filled with a flowable, hardenable material.

5. The system of claim 4, wherein said void is configured so as to prevent movement of said material in a vertical direction with respect to said plurality of blocks.

6. The system of claim 1, wherein said plurality of blocks further comprise a plurality of openings therethrough.

7. The system of claim 6, further comprising a flowable, hardenable material placed within said plurality of openings.

8. The system of claim 7, wherein said flowable, hardenable material is selected from the group consisting of cement, mortar, concrete and grout.

9. The system of claim 1, wherein said first longitudinal planar surface is configured to mate with a top of a foundation.

10. The masonry block system of claim 1, wherein said bottom surface of each of said plurality of blocks has a raised intermediate portion that interlocks in at least one horizontal direction with a raised intermediate portion of said top surface of each of said plurality of blocks.

11. A stacking masonry block system comprising:

a plurality of blocks, each having a configuration for interlocking with adjacently placed blocks, each of the plurality of blocks containing a cavity such that when the blocks are stacked in a vertical row, the vertical row has an opening therethrough;

an elongate starter strip element, configured for placement on a foundation, adapted to interlock with said plurality of blocks placed thereon, the elongate starter strip element having at least a first longitudinal surface and a second longitudinal surface directly connected to the first longitudinal surface, wherein the first longitudinal surface is configured to be co-planar to a base of at least one of the plurality of blocks when the at least one of the plurality of blocks is placed on the elongate starter strip, wherein an angle at the connection between said first longitudinal surface and said second longitudinal surface is acute and forms a void when the at least one of the plurality of blocks is placed on the elongate starter strip, wherein the bottom of the void is wider than the width of the opening in the vertical row; and at least one system selected from the group consisting of a hardenable, flowable material placed within said opening of said plurality of blocks, and an exterior parging system, wherein said void accepts the flow of hardenable flowable material through the opening in said vertical row.

* * * * *